US005653552A

United States Patent [19]

Wiley et al.

[11] Patent Number: 5,653,552

[45] Date of Patent: Aug. 5, 1997

[54] PROCESS FOR HEATING AN ASPHALT SURFACE

[75] Inventors: Patrick C. Wiley, Vancouver; Mostafa Joharifard, West Vancouver, both of Canada

[73] Assignee: McLean Ventures Corporation, Vancouver, Canada

[21] Appl. No.: 331,211

[22] Filed: Oct. 28, 1994

[30] Foreign Application Priority Data

Oct. 29, 1993 [CA] Canada ..... 2102090

[51] Int. Cl.[6] ..... E01C 23/14

[52] U.S. Cl. ..... 404/77; 404/95

[58] Field of Search ..... 404/75, 77, 79, 404/80, 90, 91, 92, 95; 126/271.1, 271.2 A

[56] References Cited

U.S. PATENT DOCUMENTS

| | | | |
|---|---|---|---|
| 3,843,274 | 10/1974 | Gutman | 404/91 |
| 3,970,404 | 7/1976 | Benedetti | 404/77 |
| 3,989,401 | 11/1976 | Moench | 404/95 |
| 4,124,325 | 11/1978 | Cutler | 404/95 X |
| 4,172,679 | 10/1979 | Wirtgen | 404/90 |
| 4,335,975 | 6/1982 | Schoelkopf | 404/77 |
| 4,534,674 | 8/1985 | Cutler | 404/95 X |
| 4,561,800 | 12/1985 | Hatakenaka et al. | 404/79 |
| 4,601,605 | 7/1986 | Damp et al. | 404/77 X |
| 4,682,909 | 7/1987 | Mihara | 404/91 X |
| 4,784,518 | 11/1988 | Cutler | 404/79 |
| 4,793,730 | 12/1988 | Butch | 404/77 |
| 4,850,740 | 7/1989 | Wiley | 404/79 |
| 4,929,120 | 5/1990 | Wiley | 404/77 |
| 5,484,224 | 1/1996 | Lynch | 404/77 |

FOREIGN PATENT DOCUMENTS

WO93/17185 9/1993 WIPO .

*Primary Examiner*—James A. Lisehora
*Attorney, Agent, or Firm*—Darby & Darby

[57] ABSTRACT

A process for continuously heating an asphalt surface is described. The process comprises moving a heater over the asphalt surface in successive forward and backward directions. The forward stroke of the heater is effected over a second distance and the backward stroke of the heater is effected over a first distance. The ratio of the second distance to the first distance is in the range of from about 0.10 to about 0.90. Preferably, the heater comprises at least two independent heaters arranged in series.

22 Claims, 4 Drawing Sheets

PROCESS FOR HEATING AN ASPHALT SURFACE

BACKGROUND OF THE INVENTION

1. Field of the Invention

The present invention relates to a process for continuously heating an asphalt surface.

2. Description of the Prior Art

As used throughout this specification, the term "asphalt" is meant to encompass macadam and tarmac. As is known in the art, asphalt paved road surfaces typically comprise a mixture of asphalt cement (typically a black, sticky, petrochemical binder) and an aggregate comprising appropriately sized stones, gravel and/or sand. The asphalt concrete mixture is usually laid, compressed and smoothed to provide an asphalt paved road surface.

Over time, an asphalt paved road surface can deteriorate as a result of a number of factors. For example, seasonal temperature fluctuations can cause the road surface to become brittle and/or cracked. Erosion or compaction of the road bed beneath the road surface may also result in cracking. Moreover, certain of the chemical constituents incorporated in fresh asphalt are gradually lost over time or their properties changed with time, further contributing to brittleness and/or cracking of the road surface. Where concentrated cracking occurs, pieces of pavement may become dislodged. This dislodgement can create traffic hazards, and accelerates the deterioration of adjacent pavement and highway substructure. Even if cracking and the loss of pavement pieces do not occur, the passage of traffic can polish the upper highway surface, and such a surface can be slippery and dangerous. In addition, traffic-caused wear can groove, trough, rut and crack a highway surface. Under wet highway conditions, water can collect in these imperfections and set up dangerous vehicle hydro-planing phenomena. Collected water also contributes to the further deterioration of the pavement.

Prior to about the 1970's, available methods for repairing old asphalt-paved road surfaces included: spot treatments such as patching or sealing, paving with new materials over top of the original surface, and removal of some of the original surface and replacement with new materials. Each of these methods has inherent drawbacks and limitations.

Since about the early 1970's, with increasing raw material, oil and energy costs, there has been a growing interest in trying to recycle the original asphalt. The world's highways have come to be recognized as a very significant renewable resource.

Early recycling techniques involved removing some of the original surface and transporting it to a centralized, stationary recycling plant where it would be mixed with new asphalt and/or rejuvenating chemicals. The rejuvenated paving material would then be trucked back to the work site and laid. These techniques had obvious limitations in terms of delay, transportation costs and the like.

Subsequently, technology was developed to recycle the old asphalt at the worksite in the field. Some such processes involved heating and are frequently referred to as "hot-in-place recycling" (hereinafter referred to as HIPR).

This technology comprises many known processes and machines in the prior art for recycling asphalt paved surfaces where the asphalt has broken down. Generally, these processes and machines operate on the premise of (i) heating the paved surface (typically by using large banks of heaters) to facilitate softening or plasticization of an exposed layer of the asphalt; (ii) mechanically breaking up (typically using devices such as rotating, toothed grinders; screw auger/mills; and rake-like scarifiers) the heated surface; (iii) applying fresh asphalt or asphalt rejuvenant to the heated, broken asphalt; (iv) distributing the mixture from (iii) over the road surface; and (v) compacting or pressing the distributed mixture to provide a recycled asphalt paved surface. In some cases, the heated, broken material can be removed altogether from the road surface, treated off the road surface and then returned to the surface and pressed into finished position. Much of the prior art relates to variations of some kind on this premise.

Over time, HIPR has had to address certain problems, some of which still exist today. For example, asphalt concrete (especially the asphalt cement within it) is susceptible to damage from heat. Thus, the road surface has to be heated to the point where it was sufficiently softened for practical rupturing, but not to the point of harming it. Furthermore, it was recognized that asphalt concrete is increasingly hard to heat as the depth of the layer being heated increases. Another problem results from excess and/or smoking of the asphalt surface which can lead to a negative impact on the environment. Many patents have attempted to address these problems.

U.S. Pat. No. 3,361,042 (Cutler), the contents of which are incorporated herein by reference, discloses a process for road surfacing. The process comprises the steps of: heating the road surface in a non-oxidizing environment; scarifying the heated surface deeply; piling the scarified material in windrows; heating the piled windrows in a non-oxidizing atmosphere; initially planing, levelling and kneading the heated mixture; adding minor amounts of conventional tack coat; finally planing, levelling and kneading the mixture; tamping and screeding the mixture; and compacting the mixture. The steps of initial and final planing, levelling and kneading of the mixture may be repeated during or omitted from the process.

U.S. Pat. No. 3,970,404 (Benedetti), the contents of which are incorporated herein by reference, discloses a method of reconstructing asphalt pavement. Generally, the method comprises heating the asphalt surface in successive stages during timed intervals. This gradual heating apparently permits the heat to penetrate the asphalt more deeply with minimal or no overheating thereof. The heated asphalt is then scarified to a depth not greater than that to which it has been heated. The scarified asphalt is then worked to provide a recycled asphalt surface. This method is somewhat inefficient since scarifying is effected only when the heat has penetrated the asphalt surface to a desired depth. As is well known in the art, in certain instances, the depth of heat penetration is directly related to the square root of the time provided for heat penetration, i.e. — 25 seconds may be required for the heat to penetrate to a depth of 5 millimeters while 49 seconds may be required for the heat to penetrate to a depth of 7 millimeters. Thus, increasing the time allowance for desired heat penetration results in a decrease in overall process efficiency.

U.S. Pat. No. 3,843,274 (Gutman et al. ), the contents of which are incorporated herein by reference, discloses an asphalt reclaimer. Generally, the reclaimer is adapted to carry out the following steps: heating the asphalt surface, cutting the heated surface, conveying the cut surface away from the road to a pugmill, pulverizing the cut surface in the pugmill, redistributing the pulverized asphalt back onto the road surface and levelling the redistributed asphalt to provide a recycled asphalt surface.

U.S. Pat. No. 3,989,401 (Moench), the contents of which are incorporated herein by reference, discloses an apparatus for renewing or reconditioning asphaltic pavement surfaces. Generally, the apparatus comprises a hood and burner assembly which heats a surface over which it is moved, a scarifying assembly that scrapes, breaks up and distributes the heated surface material and a levelling assembly that levels the scarified surface and material. This reference does not disclose or suggest processing of the scarified material to rejuvenate it in place.

U.S. Pat. No. 4,011,023 (Cutler), the contents of which are incorporated herein by reference, discloses a machine for recycling macadam highway pavement. The subject machine is intended to be used on a pavement surface which has been previously scarified or dislodged. This loose material is removed from the road surface, thereafter heated, mixed with fresh asphalt and spread on the original roadbed site. Heating is conducted off the road surface in a special chamber using a complicated multi-directional conveyor system. This machine is cumbersome and deficient since it requires complicated and expensive conveyors to remove the surface to be recycled from the road, to heat the removed material and reapply it thereafter.

U.S. Pat. No. 4,124,325 (Cutler), the contents of which are incorporated herein by reference, discloses a method and apparatus for recycling asphalt concrete roadways. Essentially, the process comprises heating the pavement surface with propane fired emitters; scarifying the heated surface to penetrate and excavate the entire surface to a depth of approximately ¾ inch; applying asphalt over the heated, scarified surface; mixing the excavated material; commingling the excavated material with additional hot mix in a pugmill rotor; and levelling the mix from the pugmill rotor on the roadway to provide a recycled asphalt surface.

U.S. Pat. Nos. 4,129,398 and 4,335,975 (both to Schoelkopf), the contents of each of which are incorporated herein by reference, disclose a method and apparatus for plastifying and tearing up of damaged road surfaces and covers. The method comprises plastifying (heating) and breaking up the road surface with first and second separate and distinct devices. The second device also serves the purpose of distributing, rearranging and profiling the broken-up material on the road surface in the absence of fresh asphalt being applied to the road surface. Thereafter, a third separate and distinct device is used to apply fresh asphalt or other bituminous material onto the broken-up, distributed, rearranged and profiled top surface of the road.

U.S. Pat. No. 4,226,552 (Moench), the contents of which are incorporated herein by reference, discloses an asphaltic pavement treatment apparatus and method. Generally, the method comprises heating and scarifying the asphalt surface to form a loose aggregate-asphaltic mixture on the ground surface. This mixture is then removed from the ground surface, heated, thoroughly mixed with a conditioner for the asphalt and reapplied to the ground surface as a mat. This method is inefficient since each treatment is carried out by an independently operable, portable apparatus and since the asphaltic must be removed from the road surface for reconditioning.

U.S. Pat. No. 4,534,674 (Cutler), the contents of which are incorporated herein by reference, discloses a dual lift repaving machine. The machine includes, in series: a preliminary heater; a preliminary scarifier; a main heater; a main scarifier; a sprayer for spraying liquid asphalt cutback onto the heated, scarified road surface; a first macadam dispensing device to dispense hot mix onto the sprayed, heated, scarified road surface; a first mixer for commingling the hot mix and the sprayed, heated, scarified road surface; a first screed to level and partly compact the material to form the first lift; a second macadam dispensing device to dispense additional hot mix onto the road surface; a second mixer for mixing the hot mix in situ; and a second screed to level and compact the new hot mix to provide a second road lift. The necessity of providing two lifts renders this machine complicated to use and relatively expensive to acquire.

U.S. Pat. No. 4,545,700 (Yates), the contents of which are incorporated herein by reference, discloses a process for recycling asphalt pavement. Essentially, the process purports to overcome the difficulties associated with inefficient heat penetration into the asphalt surface by providing steps of serially heating and milling multiple layers of the asphalt surface until the desired depth of asphalt has been removed and then, optionally, mixing the heated asphalt with additives. Typically, each heating/milling step results in removal of a strip which is at least ¼ inch deep. This process requires the use of many heaters and millers which are complicated and expensive machines.

U.S. Pat. No. 4,711,600 (Yates), the contents of which are incorporated herein by reference, discloses a heating device for use with asphalt pavement resurfacing equipment. The only example of resurfacing equipment disclosed is an apparatus in which layers of the road surface are successively heated, milled and removed from the road surface, via conveyors, for mixing with fresh asphalt or asphalt rejuvenant, and subsequent reapplication to the road surface. The use of a plurality of conveyors can be problematic since it adds excessive cost and complexity to the task at hand.

U.S. Pat. No. 4,784,518 (Cutler), the contents of which are incorporated herein by reference, discloses a double-stage repaving method and apparatus. The subject method includes a first stage comprising the steps of: heating an upper layer of an asphalt surface; scarifying the heated upper layer; adding recycling agent to the upper layer and thoroughly mixing and screeding the mixture to form recycled material; and adding fresh asphalt to the recycled material and milling the combination to form a mixed material thereby leaving exposed a lower layer of asphalt material. The second stage in the method comprises: conveying the mixed material from the first stage away to a paving station at the end of the process; subjecting the exposed lower layer of asphalt material to the same heating, scarifying, treatment and working steps to which the upper layer was subject; and laying the mixed material down on the exposed road surface (i.e. upper and lower asphalt layers removed) to provide a recycled road surface. This method is deficient as it requires the use of two relatively expensive and complicated conveyors.

U.S. Pat. No. 4,793,730 (Butch), the contents of which are incorporated herein by reference, discloses a method and apparatus for asphalt surface renewal. Generally, the method comprises the steps of: steam heating the asphalt surface; breaking the heated surface to a depth of about two inches and thoroughly mixing in situ lower material in the asphalt with the broken material; further steam heating the material to fuse the heated mixture into a homogeneous surface; screeding the homogeneous surface; and compacting the screed surface. The method and apparatus purportedly can be used to resurface asphaltic paving surfaces without requiring the addition of new materials or rejuvenants.

U.S. Pat. No. 4,929,120 (Wiley et al.), the contents of which are incorporated herein by reference, discloses a two-stage process for rejuvenating asphalt-paved road surfaces. In the first stage of the process, the entire width of the original asphalt surface is heated to a depth of about 1 inch and a temperature of about 200° C. The heated upper surface is then removed completely from the road surface (using scarifying, windrowing and conveying techniques) to expose a lower asphalt surface corresponding to the entire width of the original asphalt surface. In the second stage of the process, the lower asphalt surface is heated to a depth of about 1 inch and a temperature of about 200° C. The heated lower surface is then ruptured (e.g. scarified) and either left in place or completely removed from the road surface. If the ruptured lower surface is left in place, asphalt from the upper layer and, optionally, fresh asphalt (or asphalt rejuvenant) is applied thereover. Alternatively, if the ruptured lower surface is completely removed it may be commingled with asphalt from the upper layer and, optionally, fresh asphalt (or asphalt rejuvenant), and thereafter returned to the road surface. Finally, pressure is applied to force the upper/lower layer mixture against the road surface to provide a smooth, recycled surface. This process is somewhat deficient since it requires removal of at least the upper portion of the asphalt surface necessitating the use of relatively expensive and complicated equipment.

U.S. Pat. No. 4,850,740 (Wiley), the contents of which are incorporated herein by reference, discloses a method and apparatus for preparing asphaltic pavement for repaving. This patent purportedly provides an improvement over U.S. Pat. No. 4,929,120 by eliminating the need to remove the upper layer of heated, scarified asphalt completely away from the road surface prior to treatment of the lower layer of asphalt. Essentially, the improvement relates to heating, scarifying and windrowing the asphalt surface in a manner to provide a central strip comprising windrowed material from outer strips of the asphalt surface piled onto an untreated (i.e. not scarified/removed) central strip of the asphalt surface. The central strip is then ground to mix the centrally windrowed material with the previously unground central strip of the asphalt surface. This mix is then spread over the entire asphalt surface and pressed into place. This process is somewhat deficient since it requires two separate and distinct grinding steps.

As is apparent from the foregoing, many efforts have been made in the prior art to deal with the inherent difficulty of adequately and uniformly heating an asphalt surface in an efficient manner while minimizing or eliminating burning and smoking of the asphalt surface. To the Applicant's knowledge, much of this effort has involved utilizing relatively complicated means to distribute heat through the asphalt surface after rupturing thereof. This has involved treating the ruptured surface on or off the asphalt surface, and thereafter reapplying and pressing the ruptured surface to create a recycled asphalt surface. For example, it is believed that most of the prior art techniques require further heating of the ruptured asphalt surface to facilitate heat distribution therethrough. Such complicated processing means are typically cumbersome and large yet are necessary due to the inability to preheat the unruptured asphalt surface adequately without overheating thereof. Further, the need for complicated processing means increases the capitol cost associated with the process and dictates the need for highly skilled operators.

It would be desirable to have a process of heating an asphalt surface in a manner which facilitated subsequent recycling thereof. Ideally, such an asphalt surface heating process could be conducted utilizing conventional asphalt heaters and coupled with a relatively simple recycling system to provide a recycled asphalt surface. Preferably, the process would be capable of heating the unruptured asphalt surface to a sufficient extent such that the requirement further heating after rupturing could be obviated or mitigated. This would result in the ability to reduce the amount of equipment necessary to effect recycling of the asphalt surface and thereby reduce the capital cost associated with the overall recycling process.

SUMMARY OF THE INVENTION

It is an object of the present invention to provide a novel process for heating an asphalt surface.

It is another object of the present invention to provide a process for heating an asphalt surface which obviates or mitigates at least one of the foregoing disadvantages of the prior art.

The present inventors have discovered that it is possible to achieve relatively uniform and efficient heating of an asphalt surface to a desired depth if preheating of the asphalt surface is accomplished in a particular manner. Generally, it has been discovered that vastly improved preheating of the asphalt surface, with minimal or no overheating thereof, can be achieved by reciprocating the motion of heating. More specifically, by cyclically translating the heating means over the asphalt surface a first distance and thereafter backtracking the heating means a second distance which is less than the first distance, the asphalt surface may be heated uniformly to a desired depth in an efficient manner. By preheating the asphalt surface in this manner, it has been further discovered that heating can be accomplished efficiently, relatively uniformly and to a desired depth while obviating or mitigating damage to the asphalt surface associated with overheating thereof. Further, the present process can be used while minimizing or eliminating burning and/or smoking of the asphalt surface.

Accordingly, in one of its aspects, the present invention provides a process for continuously heating an asphalt surface comprising the steps of:

(i) providing asphalt surface heating means on the asphalt surface;

(ii) translating the heating means a first distance along the asphalt surface;

(iii) reversing the direction of and translating the heating means a second distance along the asphalt surface in a direction substantially opposite to that in Step (ii);

(iv) reversing the direction of and translating the heating means a first distance along the asphalt surface in a direction substantially the same as that in step (ii); and (v) repeating Steps (iii) and (iv) in a cyclic manner to provide a heated asphalt surface;

wherein the ratio of the second distance to the first distance is in the range of from about 0.10 to about 0.90.

In another of its aspects, the present invention provides a process for continuously heating an asphalt surface comprising the steps of:

(i) providing asphalt surface heating means comprising a leading heater and a trailing heater arranged in series on the asphalt surface;

(ii) translating the heating means a first distance along the asphalt surface;

(iii) reversing the direction of and translating the heating means a second distance along the asphalt surface in a direction substantially opposite to that in Step (ii);

(iv) reversing the direction of and translating the heating means a first distance along the asphalt surface in a direction substantially the same as that in Step (ii); and (v) repeating Steps (iii) and (iv) in a cyclic manner to provided a heated asphalt surface;

wherein the ratio of the second distance to the first distance is in the range of from about 0.10 to about 0.90.

Preferably, in this embodiment of the invention, the heating means further comprises at least one intermediate heater between the leading heater and the trailing heater.

In a preferred aspect of the invention, the process further comprises the steps of:

(vi) rupturing the heated asphalt surface to a depth of at least about 1.5 inches to provide a ruptured upper surface and an unruptured surface therebelow;

(vii) mixing the ruptured upper surface while it is on the unruptured surface to produce a ruptured upper surface which is substantially free of moisture; and (viii) pressing the heated, ruptured upper surface to provide a recycled asphalt surface.

In yet a further preferred aspect of the present invention, the process further comprises the steps of:

(vi) rupturing the heated asphalt surface to a desired depth, the ruptured surface overlying a remaining unruptured portion of the asphalt surface;

(vii) mixing at least some of the ruptured surface on the unruptured portion asphalt surface; and (viii) pressing the ruptured surface to form a recycled asphalt surface.

BRIEF DESCRIPTION OF THE DRAWINGS

Embodiments of the present invention will be described with reference to the accompanying drawings, in which.

DETAILED DESCRIPTION OF THE PREFERRED EMBODIMENTS

Figure 1:
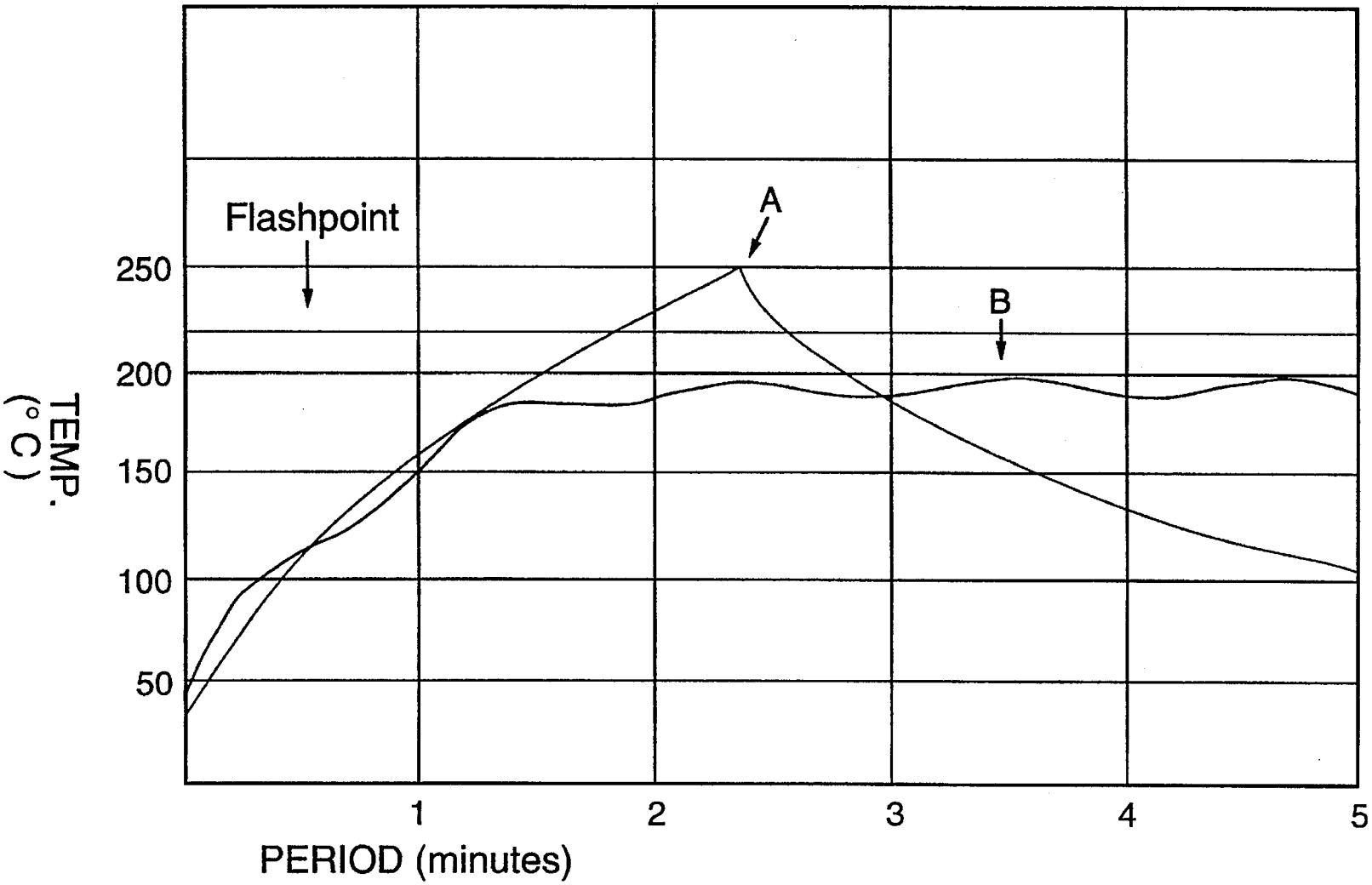
FIG. 1 is a graphic illustration of the temperature/time relationship for a conventional asphalt heating process and the present process.

One of the advantages accruing from the present process is the ability to use conventional asphalt surface heaters to effect, in some cases, all of the heating necessary for recycling prior to rupture of the asphalt surface. Thus, the choice of asphalt surface heating means is not particularly restricted and use may be made of radiant heaters (e.g. infrared heaters), hot air heaters, convection heaters, microwave heaters, direct flame heaters and the like. Generally, the heater is an independent, self-propelled vehicle which comprises a series of rows of elongate heaters extending transversely across the asphalt surface. The preferred heating means for use in the present process is a series of propane or diesel fired infrared heaters. Such heaters are well known in the art.

Generally, it is preferred that the vehicular heating means used in the present process may be readily switched from forward to reverse operation, and vice versa. The manner by which this is accomplished is not particularly restricted and is within the purview of those of skill in the art.

The asphalt surface heating means is: moved forward a first distance; reversed; and thereafter moved backward in an opposite direction a second distance. The ratio of the second distance to the first distance is in the range of from about 0.10 to about 0.90. Thus, when the ratio is 0.90, for every 10 units of distance the asphalt surface heating means is moved forward, it is moved backwards 9 units of distance. Similarly, when the ratio is 0.10, for every 10 units of distance the asphalt surface heating means is moved forward, it is moved backwards 1 unit of distance.

Preferably, the ratio of the second distance to the first distance is in the range of about 0.30 to about 0.90, more preferably in the range of from about 0.50 to about 0.90.

It is well known in the art that overheating of the asphalt surface must be avoided since this can result in ignition of and/or damage to the asphalt surface. Specifically, it is well known in the art that an asphalt mixture to a temperature above about 160° C. can result in damage to the asphalt cement. It is also well known in the art that the surface of asphalt pavement in need of recycle may heated to a temperature approaching the flashpoint of the asphalt since, typically, the surface oil has been worn off, washed away or severly oxidized. Typically, the flash point of an asphalt surface is at a temperature exceeding about 210° C. Using the process of the present invention, it is possible to heat an unruptured asphalt surface to a temperature close to but not exceeding the flash point of the asphalt surface. Moreover, it is possible to maintain the unruptured asphalt surface at substantially this temperature. Thus, it is particularly preferred in the present process that the asphalt surface is heated to a temperature less than about 200° C., more preferably a temperature in the range of from about 100° C. to about 190° C., most preferably in the range of from about 130° C. to about 190° C.

The ability to achieve such uniform and steady-state heating of the asphalt surface is illustrated in FIG. 1. Specifically, curve A is a representative temperature/time relationship associated with passing an infrared heater over an asphalt surface in the conventional manner (i.e. moving the heater in a single direction at a substantially constant speed). As is apparent, the temperature of the asphalt surface peaks between 2 and 3 minutes after initiating of heating to a temperature above the flashpoint of the asphalt surface. In comparison, curve B is representative of the temperature/time relationship obtained using the process of the present process (i.e. reciprocating movement of the heater in an unbalance manner). As illustrated, the temperature of the asphalt surface is increased to but does not exceed 200° C., i.e. below the flashpoint of the asphalt surface.

Figure 2:
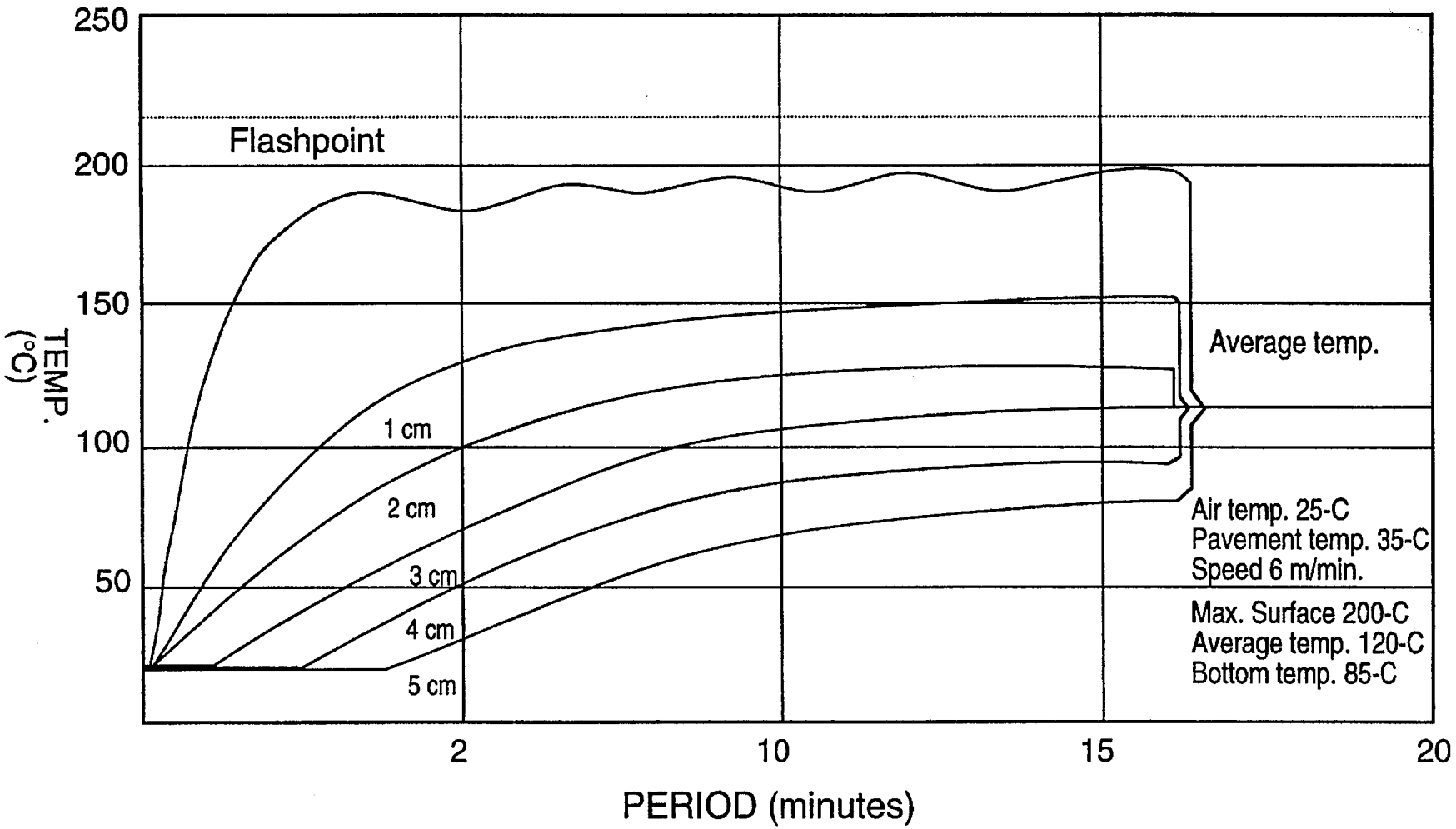
FIG. 2 is a graphic illustration of the temperature/time relationship for an asphalt surface at various depths utilizing the present process.

This point is further illustrated with reference to FIG. 2 which provides individual temperature/time relationship curves for the asphalt surface at the following depths: 0 cm, 1 cm, 2 cm, 3 cm, 4 cm and 5 cm. As can be seen, the temperature varies from 200° C. at 0 cm (on the asphalt surface itself) to 80° C. 5 centimeters (approximately 2 inches) below the surface. The average temperature of the 5 centimeter layer is approximately 120° C. This time/temperature profile is highly advantageous and simplifies recycling of the asphalt surface.

A particularly preferred embodiment of the present invention is the use of an asphalt surface heating means comprising at least two independent heaters. Ideally, the heaters are arranged in series, with a leading heater and a trailing heater. More preferably, at least one intermediate heater is disposed between the leading heater and the trailing heater. When two or more independent heaters are used, it is preferred that the above-described uneven reciprocating translation thereof is conducted in a uniform manner.

When two or more independent heaters are used in the present process, it is preferred that they be connected to each other to facilitate uniform translation of all of the heaters.

It is further preferred that, when two or more independent heaters are used, each heater be operated at a different temperature. Further, it is preferred that operation of the independent heaters at a different temperature creates a temperature gradient (i.e. of the heat output by the heaters) as the heating means in its entirety is translated along the asphalt surface. More preferably, the temperature gradient is a decrease in operation temperature of from leading heater to the trailing heater. A particularly advantageous manner of utilizing the temperature gradient associated with this embodiment of the invention is, for each independent heater, to vary the temperature depending on whether the heater is being translated in Step (iii) (i.e. relatively backward stroke) or Step (iv) (i.e. relatively forward stroke). Specifically, for each independent heater, it is most preferred, to have greater heater operational temperature in relatively forward stroke than the heater operational temperature in the relatively backward stroke while maintain the overall preferred temperature gradient between individual heaters.

One of the key advantages of the present process is that it may comprise the entire heating requirement in the overall asphalt surface recycling process. Thus, while it is contemplated that the present process may be used in conjunction with many of the prior art processes described above, it may also be utilized with a greatly simplified remixer which is devoid of heaters. This is believed to be a significant advance in the art.

Figure 3A:
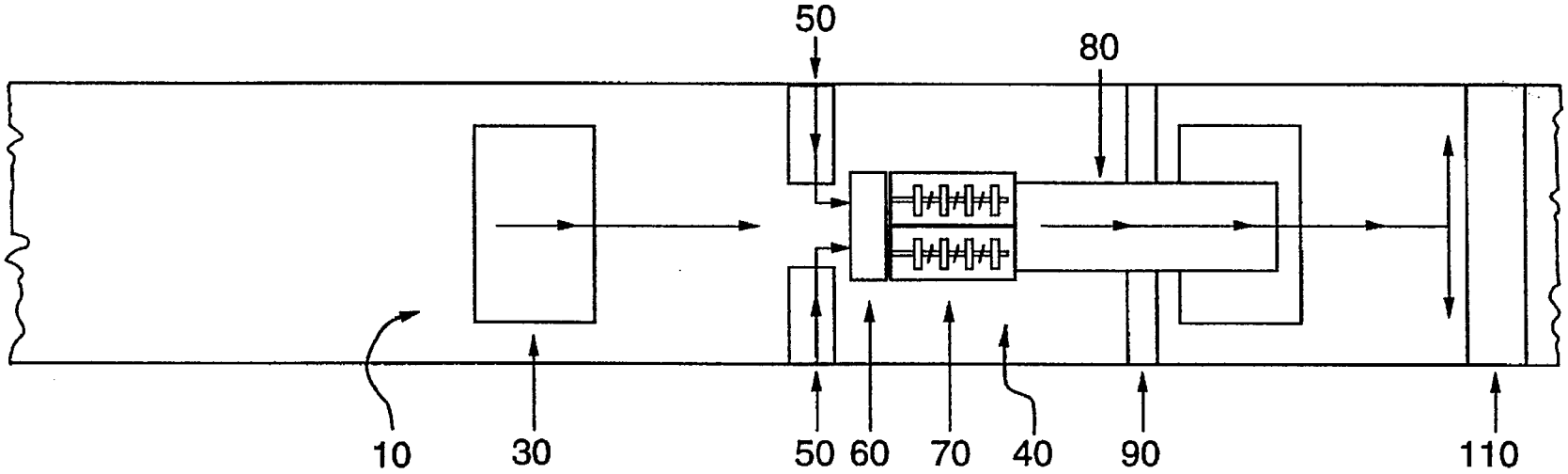
FIG. 3 (comprising FIGS. 3A and 3B) is an illustration of a remixer capable of being used in conjunction with the present process.
Figure 3B:
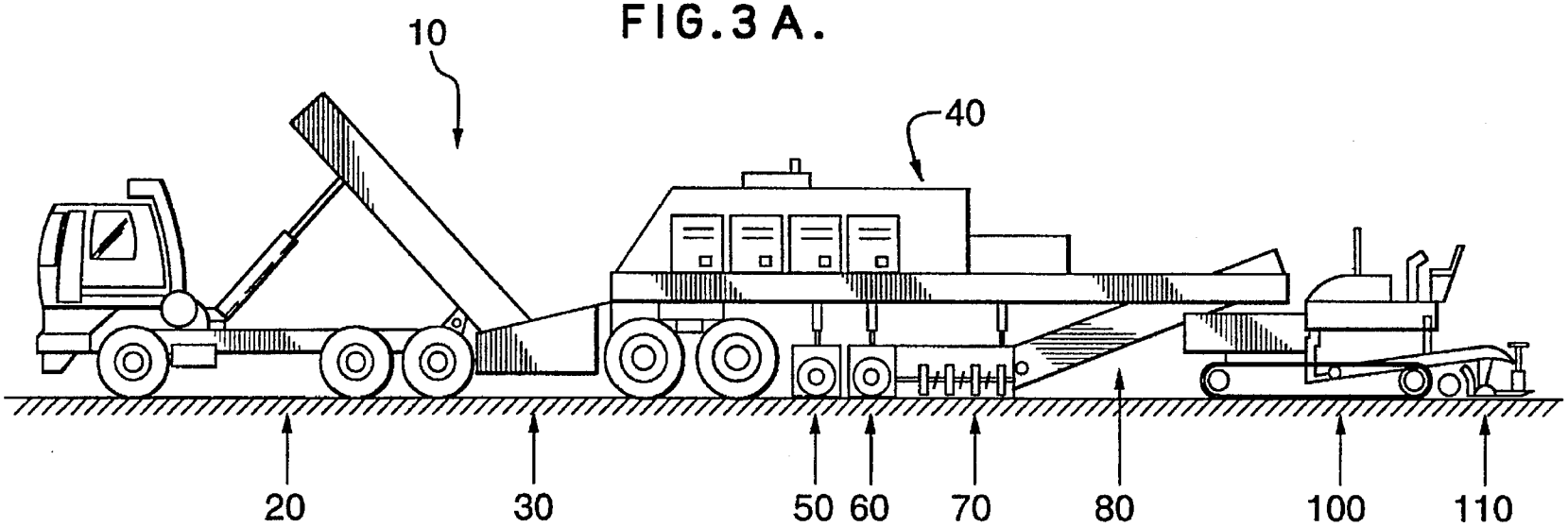

While the choice of remixer is not particularly restricted, a preferred remixer is depicted in FIG. 3. In FIG. 3, the remixer is shown in a top schematic view in FIG. 3A and side elevation in FIG. 3B. Thus, a remixer is illustrated generally at 10. The leading portion of remixer 10 comprises a dump truck 20 connected to a hopper 30 which is attached to a grinder/mixer shown generally at 40. Grinder/mixer 40 comprises a pair of leading grinders 50 and a trailing grinder 60 such that the overall effect of grinders 50 and 60 is to traverse the asphalt surface to be recycled. Trailing grinder 60 is connected to a pugmill 70 which, in turn, is connected to a conveyor 80. Below conveyer 80, there is disposed a repave screed 90. The trailing portion of grinder/mixer 40 is connected to a paver 100. Paver 100 serves to propel itself and grinder/mixer 40 in unison with dump truck 20. The trailing portion of paver 100 comprises a screed 110.

In use, dump truck 20 would be loaded with fresh asphalt and/or asphalt rejuvenant and, in unison with grinder/mixer 40 and paver 100, would be propelled behind the heater or heaters used in the present process. The fresh asphalt/asphalt rejuvenant is dispensed from dump truck 20 via hopper to the heated asphalt surface. It will be appreciated that the fresh asphalt/asphalt rejuvenant may be optionally preheated prior to application to the heated asphalt surface. The heated asphalt surface, with the fresh asphalt/asphalt rejuvenant lying thereon, is then ground in place by grinders 50 and 60, and thereafter is thoroughly mixed in pugmill 70. Thereafter, the thoroughly mixed product exiting pugmill 70 is lifted off the unruptured surface via conveyor 80 while repave screed 90 serves to level the unruptured surface. The mixed product is reapplied to the unruptured asphalt surface and pressed into place by screed 110 on the trailing portion of paver 100.

It will be apparent to those of skill in the art that many variations may be made to this embodiment of the invention while maintaining the advantages associated therewith. For example, it may be possible to added the fresh asphalt at a more downstream point rather than prior to operation of grinder/mixer 40. Further, in certain applications, it may be possible to omit dump truck 20 and its contents in favour of a 100% recycle process. Alternatively, in other applications, sufficient recycling may be obtaining simply by adding oil, optionally preheated, before or during the operation of grinder/mixer 40.

A particularly preferred application of the present process is that it may be used in conjunction with a modified form of the process and apparatus described in published International (PCT) patent application No. WO 93/17185, the contents of which are incorporated herein by reference. In this published International patent application, a process is described which comprises, inter alia, heating and mixing a ruptured asphalt surface without the need to remove the ruptured surface or use complicated windrowing techniques to achieve uniform heating thereof. The present inventors have now discovered that it is possible to use the present process with the process described in the published International patent application. More beneficially, the present inventors have discovered that the present process may be used with a more simplified version of the process described in published International patent application No. WO 93/17185. Specifically, it is contemplated that the requirement for cyclical heating and mixing as described in the published International application is not required due to ability of the present process to heat an unruptured asphalt surface in an efficient manner to a desired temperature and depth without overheating thereof. This allows for modifying the process in the published International patent application to do without the heaters interposed between the mixers.

Thus, the present process, in a preferred embodiment, comprises the further steps of:

(vi) rupturing the heated asphalt surface to a depth of at least about 1.5 inches to provide a ruptured upper surface and an unruptured surface therebelow;

(vii) mixing the ruptured upper surface while it is on the unruptured surface to produce a ruptured upper surface which is substantially free of moisture; and (viii) pressing the heated, ruptured upper surface to provide a recycled asphalt surface.

Further, the present process, in another preferred embodiment, comprises the further steps of:

(vi) rupturing the heated asphalt surface to a desired depth, the ruptured surface overlying a remaining unruptured portion of the asphalt surface;

(vii) mixing at least some of the ruptured surface on the unruptured portion asphalt surface; and (viii) pressing the ruptured surface to form a recycled asphalt surface.

The rupturing, mixing and pressing described in Steps (vi), (vii) and (viii), respectively, in both of the foregoing embodiments may be conducted using the techniques and equipment described in published International patent application No. WO 93/17185, the contents of which are incorporated herein by reference.

Depending on the nature of the overall recycling process (e.g. condition of asphalt surface, speed at which the equipment will be passing over the asphalt surface, the temperature at which the heaters are operated, the number of heaters, etc.), supplementary heaters may be used after rupturing in Step (vi) in either of the foregoing preferred embodiments.

Another preferred aspect of the present process comprises the step of dispensing an aggregate on the asphalt surface prior to heating thereof. Preferably, the aggregate is dispensed in the form of a windrow. The process is then carried out as described above such that both the asphalt surface and the windrow of aggregate are heated.

Figures 4A, 4B:
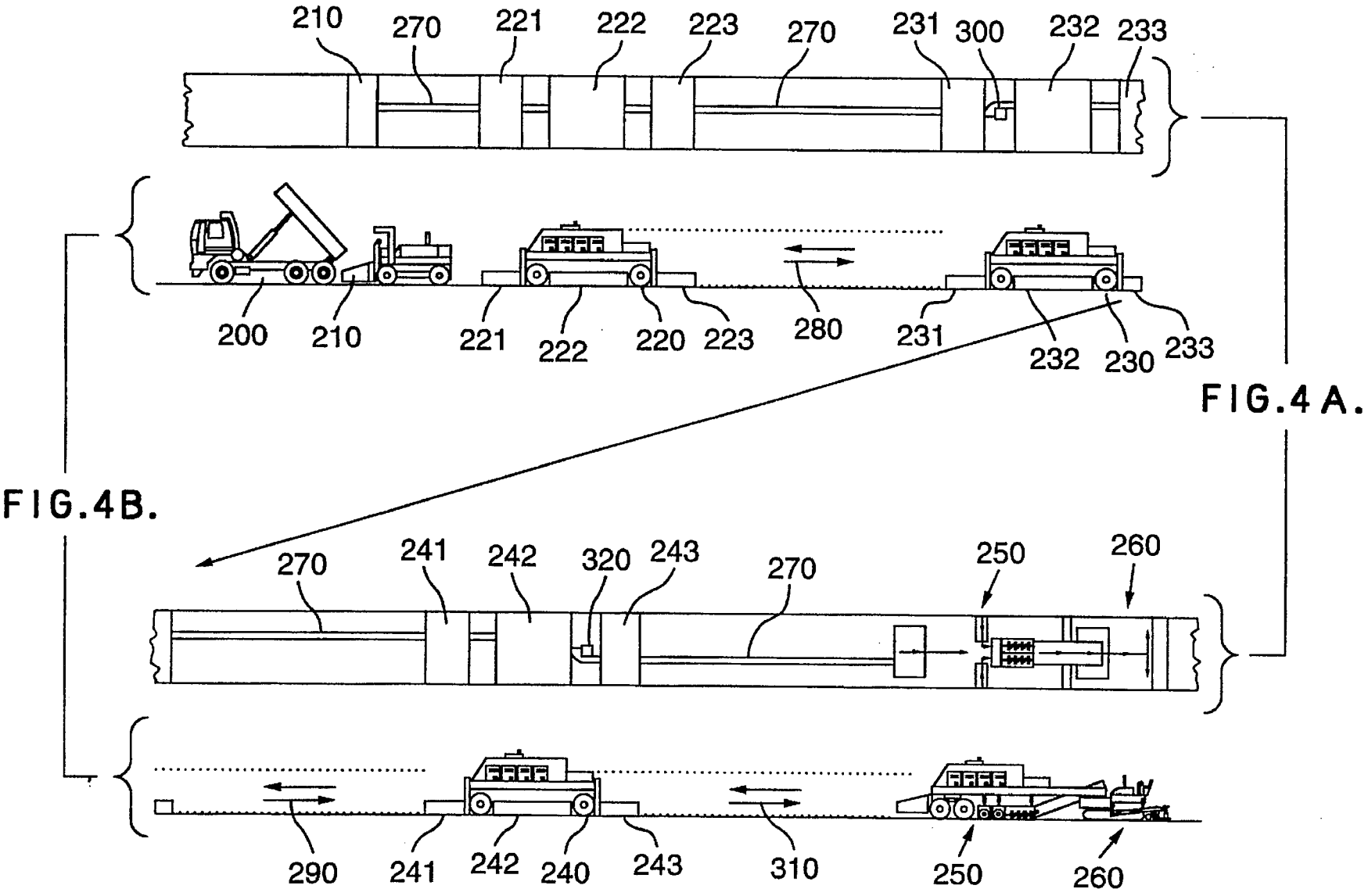
FIG. 4 (comprising FIGS. 4A and 4B) is an illustration of the embodiment of the invention where an aggregate is heated with the asphalt surface.

This embodiment of the present process is illustrated in FIG. 4. FIG. 4 is comprised of FIGS. 4A (a top schematic view) and 4B (a side view of the process) which are aligned to depict the same process.

Thus, there is illustrated a dump truck 200 leading a hopper 210. Trailing hopper 210 is a leading asphalt surface heater 220 which comprises three banks of infrared heaters 221, 222 and 223. Trailing asphalt surface heater 220 is an intermediate asphalt surface heater 230 which similarly comprises three banks of infrared heaters 231, 232 and 233. After asphalt surface heater 230 is a trailing asphalt surface heater 240 which comprises three banks of infrared heaters 241, 242 and 243. After asphalt surface heater 240 there is a grinder/mixer 250 connected to a paver 260. Grinder/mixer 250 and paver 260 are similar to the grinder/mixer (40) and paver (100) described hereinabove with reference to FIG. 4.

In use, dump truck 200 would be loaded with a suitably sized aggregate and propelled, in unison, with hopper 210. As dump truck 200 and hopper 210 are propelled, aggregate is dispensed from dump truck 200 to hopper 210 and is formed into a windrow 270 on the (unheated) asphalt surface. Thereafter, leading asphalt surface heater 220 is passed over the asphalt surface/aggregate windrow in a reciprocating manner as depicted by arrows 280. Next, intermediate asphalt surface heater 230 passes over the asphalt surface/aggregate windrow in a reciprocating manner as illustrated by arrows 290. Further, as shown, trailing bank of heaters 231, there is a cylindrical broom 300 which serves to shift the aggregate windrow sideways by approximately one windrow width. Preferably, cylindrical broom 300 is lowered when intermediate asphalt surface heater 230 is moved in a forward direction (i.e. toward dump truck 200) and raised when it is moved in a rearward direction (i.e. toward paver 260). Thereafter, trailing asphalt surface heater 240 passes over the asphalt surface/aggregate windrow in a reciprocating manner as depicted by arrows 310. Trailing bank of heaters 242 is a cylindrical broom 320 which operates similarly to cylindrical broom 300 but serves to shift aggregate windrow 270 to the opposite side of the asphalt surface. Finally, the recycling process is completed by grinder/mixer 250 and paver 260 in a manner similar to that described above with reference to FIG. 4.

As will be appreciated, many variations of the disclosed process are possible without deviating from the spirit and substance thereof. Accordingly, while this invention has been described with reference to illustrative embodiments, this description is not intended to be construed in a limiting sense. Various modifications of the illustrative embodiment as well as other embodiments of the invention will be apparent to persons skilled in the art upon reference to this disclosure. It is therefor contemplated that the dependant claims with cover any such modifications or embodiments.

What is claimed is:

1. A process for continuously heating an asphalt surface comprising the steps of:

(i) providing asphalt surface heating means on said asphalt surface, the heating means comprising at least two independent heaters arranged in series;

(ii) translating said heating means a first distance along said asphalt surface;

(iii) reversing the direction of and translating said heating means a second distance along said asphalt surface in a direction substantially opposite to that in Step (ii);

(iv) reversing the direction of and translating said heating means said first distance along said asphalt surface in a direction substantially the same as that in Step (ii); and (v) repeating Steps (iii) and (iv) in a cyclic manner to provide a heated asphalt surface;

wherein the ratio of the second distance to the first distance is in the range of from about 0.10 to about 0.90.

2. The process defined in claim 1, wherein the asphalt surface is heated to a temperature less than about 200° C.

3. The process defined in claim 2, wherein at least one of said heaters is an infrared heater.

4. The process defined in claim 2, wherein the ratio of the second distance to the first distance is in the range of from about 0.30 to about 0.90.

5. The process defined in claim 4, wherein each of said independent heaters is operated at a different temperature.

6. The process defined in claim 5, wherein operation of each of said independent heaters at a different temperature creates a temperature gradient as said heating means is translated along the asphalt surface.

7. The process defined in claim 6, wherein the temperature gradient is a decrease in operation temperature of each of said independent heaters.

8. The process defined in claim 7, wherein each of said independent heaters is operated at a greater temperature in Step (iv) than in Step (iii).

9. The process defined in claim 4, wherein each of said independent heaters is connected to provide uniform translation thereof along the asphalt surface.

10. The process defined in claim 2, further comprising the step of dispensing an aggregate on said asphalt surface prior to Step (ii).

11. The process defined in claim 10, wherein the aggregate is dispensed in the form of a windrow.

12. The process defined in claim 11, wherein Step (ii) further comprises mixing the aggregate while it is on the asphalt surface.

13. The process defined in claim 11, wherein Step (ii) further comprises shifting the aggregate on the asphalt surface to effect mixing thereof.

14. The process defined in claim 1, wherein the asphalt surface is heated to a temperature in the range of from about 100° C. to about 190° C.

15. The process defined in claim 1, wherein the asphalt surface is heated to a temperature in the range of from about 130° C. to about 190° C.

16. The process defined in claim 1, wherein at least one of said heaters is a radiant heater.

17. The process defined in claim 16, wherein the ratio of the second distance to the first distance is in the range of from about 0.50 to about 0.90.

18. The process defined in claim 17, wherein said heating means comprises three independent heaters.

19. The process defined in claim 1, wherein at least one of said heaters is a hot air heater.

20. The process defined in claim 1, further comprising the steps of:

(vi) rapturing the heated asphalt surface to a depth of at least about 1.5 inches to provide a ruptured upper surface and an unruptured surface therebelow;

(vii) mixing the ruptured upper surface while it is on the unruptured surface to produce a ruptured upper surface which is substantially free of moisture; and (viii) pressing the heated, ruptured upper surface to provide a recycled asphalt surface.

21. The process defined in claim 1, further comprising the steps of:

(vi) rupturing the heated asphalt surface to a desired depth, the ruptured surface overlying a remaining unruptured portion of the asphalt surface;

(vii) mixing at least some of the ruptured surface on the unruptured portion asphalt surface; and (viii) pressing the ruptured surface to form a recycled asphalt surface.

22. A process for continuously heating an asphalt surface comprising the steps of:

(i) providing asphalt surface heating means comprising a leading heater and a trailing heater arranged in series on said asphalt surface;

(ii) translating said heating means a first distance along said asphalt surface;

(iii) reversing the direction of and translating said heating means a second distance along said asphalt surface in a direction substantially opposite to that in Step (ii);

(iv) reversing the direction of and translating said heating means said first distance along said asphalt surface in a direction substantially the same as that in Step (ii); and (v) repeating Steps (iii) and (iv) in a cyclic manner to provide a heated asphalt surface;

wherein the ratio of the second distance to the first distance is in the range of from about 0.10 to about 0.90.

* * * * *